US011322072B1

(12) United States Patent
Kang et al.

(10) Patent No.: US 11,322,072 B1
(45) Date of Patent: May 3, 2022

(54) DISPLAY DEVICE

(71) Applicant: Au Optronics Corporation, Hsinchu (TW)

(72) Inventors: Yu-Chi Kang, Hsinchu (TW); Yi-Hsiang Hu, Hsinchu (TW); Chun-Hui Huang, Hsinchu (TW); Wei-Ting Chen, Hsinchu (TW); Yu-Chu Chen, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 17/373,779

(22) Filed: Jul. 13, 2021

(30) Foreign Application Priority Data

Nov. 5, 2020 (TW) ..... 109138565

(51) Int. Cl.
*G09G 3/20* (2006.01)
*G09G 3/32* (2016.01)

(52) U.S. Cl.
CPC ..... *G09G 3/2007* (2013.01); *G09G 3/32* (2013.01); *G09G 2320/0233* (2013.01); *G09G 2320/0242* (2013.01); *G09G 2320/0285* (2013.01); *G09G 2320/048* (2013.01); *G09G 2360/12* (2013.01)

(58) Field of Classification Search
CPC ..... G09G 3/2007; G09G 3/32; G09G 2320/0233; G09G 2320/0242; G09G 2320/0285; G09G 2320/048; G09G 2360/12
See application file for complete search history.

(56) References Cited

U.S. PATENT DOCUMENTS

2007/0165015 A1 7/2007 Li et al.
2011/0175944 A1* 7/2011 Kuo ..... G09G 3/32 345/690

FOREIGN PATENT DOCUMENTS

JP H08186826 7/1996

* cited by examiner

*Primary Examiner* — Andrew Sasinowski
(74) *Attorney, Agent, or Firm* — JCIPRNET

(57) ABSTRACT

A display device is provided. The display device includes a panel, a memory, and a controller. The panel includes multiple pixels. The memory includes a first section and a second section. The memory stores an aging record table. Multiple brightness attenuation values recorded in the aging table are respectively divided into multiple first portion attenuation values and multiple second portion attenuation values. The first section stores the first portion attenuation values. The second section stores the second portion attenuation values. The controller includes an update circuit and a compensation circuit. The controller is coupled to the panel and the memory. The update circuit receives gray values displayed by the pixels to update the aging table. The compensation circuit reads the first portion attenuation values from the first section so as to perform an aging compensation on the pixels.

10 Claims, 5 Drawing Sheets

DISPLAY DEVICE

CROSS-REFERENCE TO RELATED APPLICATION

This application claims the priority benefit of Taiwan application serial no. 109138565, filed on Nov. 5, 2020. The entirety of the abovementioned patent application is hereby incorporated by reference herein and made a part of this specification.

BACKGROUND

Technical Field

This disclosure relates to a device, and in particular to a display device.

Description of Related Art

In an existing display device, in response to color decay due to aging of pixels, the display device may store an aging degree of each pixel in a memory, to serve as a reference for compensating the pixels. As a result, frequent reading and writing of the memory during the compensation process cause a burden on memory bandwidth.

SUMMARY

The disclosure provides a display device, which can reduce a bandwidth required for accessing a memory in the display device.

The display device of the disclosure includes a panel, a memory, and a controller. The panel includes multiple pixels. The memory includes a first section and a second section. An aging record table is stored in the memory, and multiple brightness attenuation values in the aging record table corresponding to the pixels are respectively divided into multiple first portion attenuation values and multiple second portion attenuation values. The first section stores the first portion attenuation values, and the second section stores the second portion attenuation values. The controller includes an update circuit and a compensation circuit. The controller is coupled to the panel and the memory. The update circuit receives grayscale values displayed by the pixels to update the aging record table. The compensation circuit reads the first section to obtain the first portion attenuation values to perform an aging compensation on the pixels.

Based on the above, the display device divides the brightness attenuation values in the aging record table into the first portion attenuation values and the second portion attenuation values, and respectively stores the first portion attenuation values and the second portion attenuation values in the first section and the second section of the memory. In this way, the bandwidth requirement of the memory in the display device can be effectively reduced.

To make the abovementioned more comprehensible, several embodiments accompanied by drawings are described in detail as follows.

DESCRIPTION OF THE EMBODIMENTS

Figure 1:
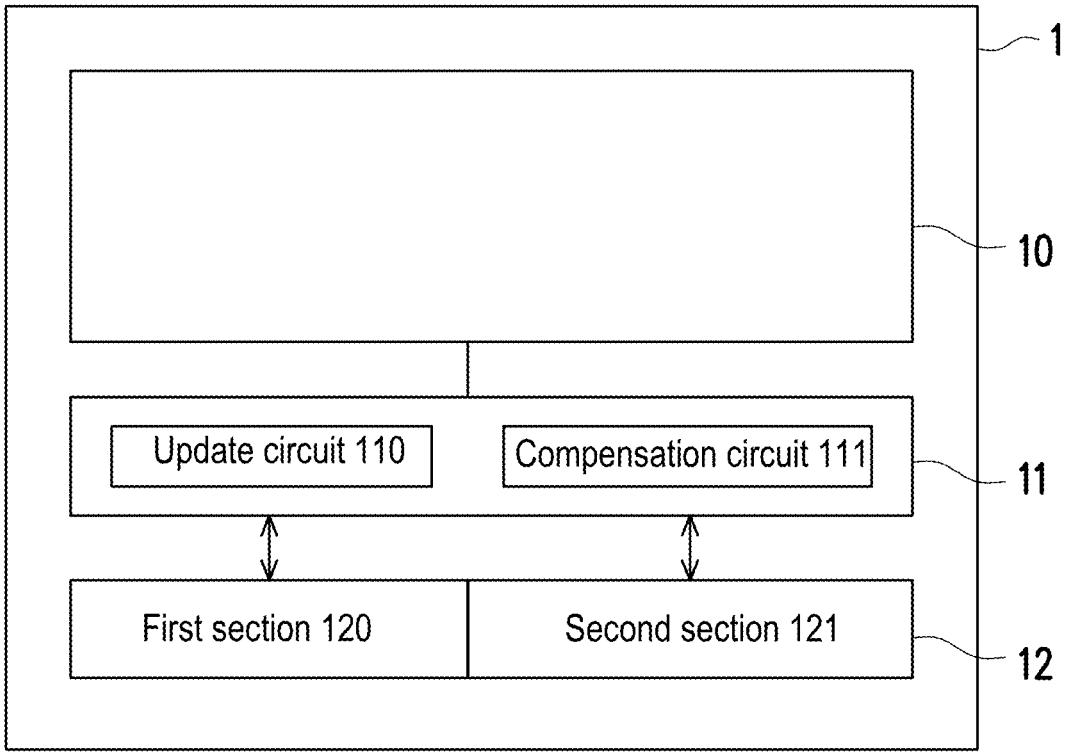
FIG. 1 is a schematic diagram of a display device according to an embodiment of the disclosure.

FIG. 1 is a schematic diagram of a display device 1 according to an embodiment of the disclosure. The display device 1 includes a panel 10, a controller 11, and a memory 12. Although not shown in FIG. 1, the panel 10 includes multiple pixels for displaying an image. An aging record table is stored in the memory 12. The aging record table records a brightness attenuation value corresponding to each of the pixels, and the brightness attenuation values may be divided into first portion attenuation values and second portion attenuation values. The memory 12 stores the first portion attenuation values in a first section 120 of the memory 12, and stores the second portion attenuation values in a second section 121 of the memory 12. The controller 11 is coupled to the panel 10 and the memory 12, and the controller 11 includes an update circuit 110 and a compensation circuit 111. The update circuit 110 may receive a grayscale value displayed by each of the pixels, and accordingly update each of the brightness attenuation values recorded in the aging record table. The compensation circuit 111 may read the first section 120, and then obtain the first portion attenuation values to perform an aging compensation on each of the pixels.

For an overall operation of the display device 1, in an embodiment, the pixels included in the panel 10 may attenuate and age according to display time, display grayscale and/or display brightness, or other factors. Furthermore, an aging degree of each of the pixels may be converted to the multiple brightness attenuation values and stored in the aging record table in the memory 12. In an embodiment, each of the brightness attenuation values may ben bits of data, and a most significant bit (MSB) of m bits in the brightness attenuation values may be classified as a first portion attenuation value, and a least significant bit (LSB) of n-m bits in the brightness attenuation values may be classified as a second portion attenuation value. Furthermore, the first portion attenuation value may be stored in the first section 120 of the memory 12, and the second portion attenuation value may be stored in the second section 121 of the memory 12. Since the first portion attenuation value and the second portion attenuation value are stored in different memory sections, the controller 11 may access the first section 120 or the second section 121 through different memory addresses when the first section 120 or the second section 121 is accessed.

Moreover, aging occurring on the device 1 is a long accumulation process, and variation on the display device 1 occurs gradually. In view of this, fineness of an aging value (n bit) has to have discrimination for trace amounts of the aging value of the accumulation process. However, for pixel compensation, taking into consideration the n bits that have such a huge aging range, a compensation circuit is a considerable burden on hardware cost and access bandwidth. Therefore, when a sufficient amount of MSB aging value is appropriately obtained for calculation of the compensation, the hardware cost is greatly reduced. In this way, the compensation circuit 111 may only read the first section 120 of the memory 12 when the compensation circuit 111 in the controller 11 reads the memory 12 to perform the aging compensation, while the display device 1 performs the aging compensation through only obtaining a portion of the brightness attenuation values in the aging record table, a data throughput between the controller 11 and the memory 12 may be effectively reduced, and a data bandwidth of the display device 1 is effectively improved.

Figure 2:
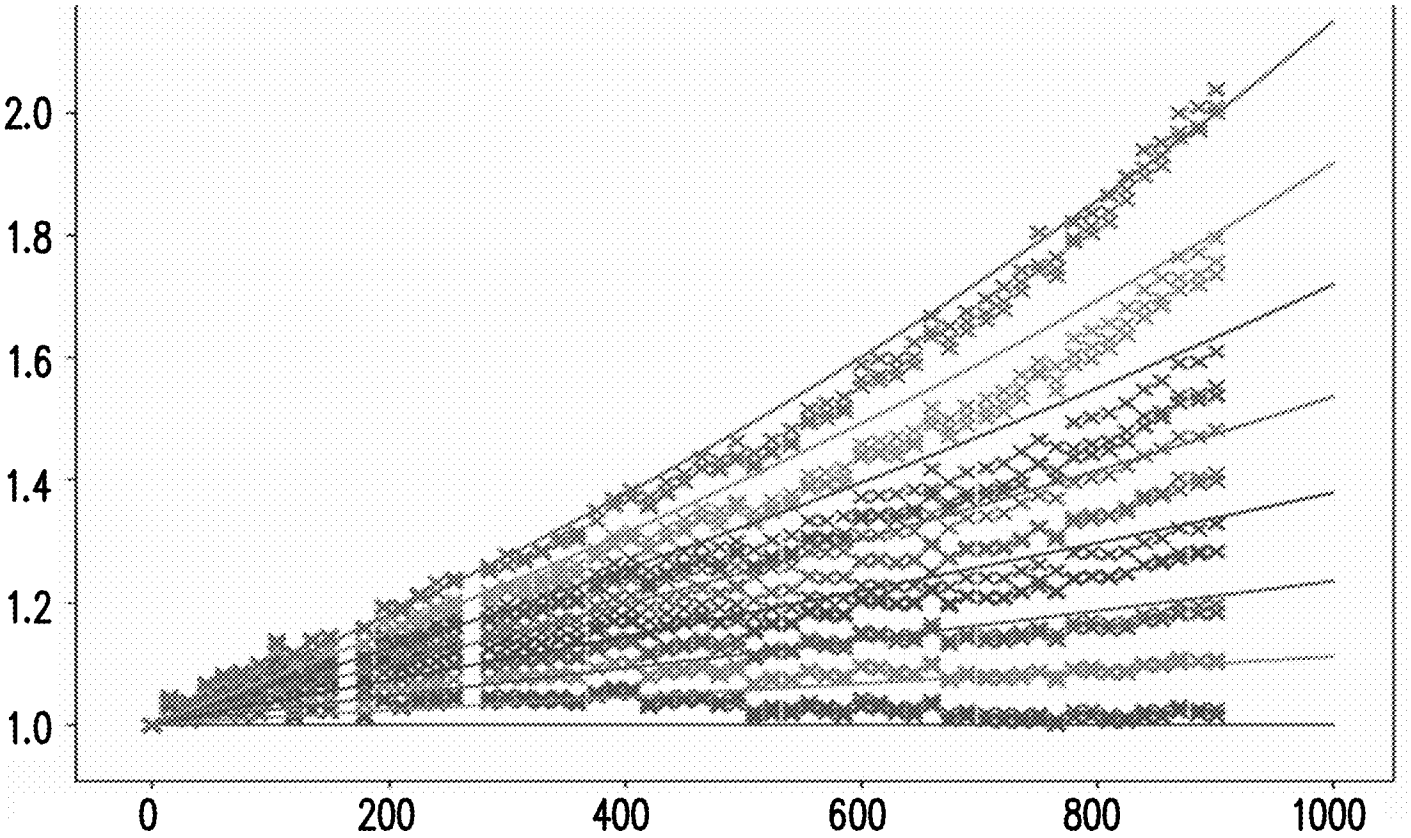
FIG. 2 is a diagram of a relationship between a brightness ratio of a pixel and a display time according to an embodiment of the disclosure.

For a detailed operation of the display device 1, in the panel 10, in an embodiment, the pixels included in the panel 10 may be, for example, a light-emitting diode (LED), or a micro LED, a mini LED, an organic LED (OLED), etc., or pixels composed of other suitable circuits. As usage time increases, each of the pixels deteriorates and ages according to the display time, the display grayscale, the display brightness, or other factors. More specifically, for the aging of the pixels, reference is made to FIG. 2. FIG. 2 is a diagram of a relationship between a brightness ratio of a pixel and a display time according to an embodiment of the disclosure, where a vertical axis is a ratio of an original brightness of the pixel divided by a current brightness of the pixel, and a horizontal axis is the display time of the pixel. Different graphs in FIG. 2 represent a change in the relationship between the brightness ratio of the pixel at different display gray levels and the display time. As shown in FIG. 2, as the display time increases, brightness emitted by the pixels gradually ages, while increases the ratio and extends a direction of the graph to upper right. On the other hand, in a case of displaying different grayscale values, display brightness, or applied voltage, there are different degrees of impact on the aging of the pixels, so that the brightness change graphs corresponding to the different grayscales have different slopes.

In the memory 12, the aging record table stored in the memory 12 may contain the multiple brightness attenuation values. Each of the brightness attenuation values corresponds to each of the pixels in the panel 10, and the brightness attenuation value may represent the aging degree of each of the pixels. The memory 12 may be, for example, any type of fixed or removable random access memory (RAM), a read-only memory (ROM), a flash memory, a hard disk drive (HDD), a solid state drive (SSD), or similar elements, or a combination of the above elements.

Furthermore, in the memory 12, the different memory sections may be used to store the first portion attenuation values and the second portion attenuation values divided from the brightness attenuation values. The memory 12 may store the first portion attenuation values in the first section 120, and store the second portion attenuation values in the second section 121. In an embodiment, the brightness attenuation value may be the data with n bits, and the most significant bit (MSB) of the m bits in the brightness attenuation values may be classified as the first portion attenuation value, and the least significant bit (LSB) of the n-m bits in the brightness attenuation values may be classified as the second portion attenuation value. In other words, the first section 120 may store the m-bits most significant bits of all the brightness attenuation values, and the second section 121 may store the n-m-bits least significant bits of all the brightness attenuation values. In an embodiment, each of the brightness attenuation values stored in the aging record table may be image data, voltage value, current value, compensation value, correction parameter, or other suitable data content. In this way, the different memory addresses may be used to access the first portion brightness attenuation values and the second portion brightness attenuation values when the brightness attenuation values in the aging record table are accessed.

In the controller 11, the controller 11 is coupled to the panel 10 and the memory 12, and the controller 11 includes the update circuit 110 and the compensation circuit 111. The update circuit 110 may receive the grayscale value, the display brightness, or the applied voltage of each of the pixels to update the aging record table. The compensation circuit 111 may read the first section 120 to obtain the first portion attenuation values to perform the aging compensation on each of the pixels. The controller 11 may be, for example, a central processing unit (CPU), or other programmable general-purpose or special-purpose micro control unit (MCU), a microprocessor, a digital signal processor (DSP), a programmable controller, an application-specific integrated circuit (ASIC), a graphics processing unit (GPU), an arithmetic logic unit (ALU), a complex programmable logic device (CPLD), a field programmable gate array (FPGA), or other similar elements, or a combination of the above elements. Alternatively, the controller 11 may be a hardware circuit designed through a hardware description language (HDL) or any other digital circuit design means familiar to those with ordinary knowledge in the field, and implemented through means such as the field programmable gate array (FPGA), the complex programmable logic device (CPLD), or the application-specific integrated circuit (ASIC). In an embodiment, the update circuit 110 and the compensation circuit 111 may be circuit sections designed through design means such as full custom design or standard cell. Alternatively, the update circuit 110 and the compensation circuit 111 may be two separated or mutually integrated circuit sections designed by programming and controlling the controller 11 through a programming language.

In detail, the update circuit 110 is coupled to the panel 10 and the memory 12. The update circuit 110 may receive the grayscale value, the display brightness, or the applied voltage displayed by each of the pixels to update the aging record table. In an embodiment, the update circuit 110 may, for example, obtain the diagram of the relationship between the brightness ratio of the pixel and the display time shown in FIG. 2 through a burn-in test, and convert the diagram of the relationship between the brightness ratio and the display time to an aging look-up table, and then store the aging look-up table in the update circuit 110. Furthermore, the update circuit 110 may quantize or normalize the aging degree or brightness attenuation of each of the pixels through the stored aging look-up table, and store them in the aging record table.

In an embodiment, the update circuit 110 may query the aging look-up table by receiving the grayscale value, the display brightness, or the applied voltage displayed by each of the pixels in the panel 10, so as to update the aging record table stored in the memory 12. In an embodiment, the update circuit 110 may query the aging look-up table according to the grayscale value, the display brightness, or the applied voltage displayed by each of the pixels in one or multiple frame times, so as to obtain a brightness variation value generated by each of the pixels in the one or the multiple frame times. That is, aging caused by each of the pixels being displayed in the one or the multiple frame times. In addition, the update circuit 110 may also obtain the brightness attenuation value of each of the pixels through reading the aging record table. The update circuit 110 may sum the brightness attenuation value and the brightness variation value of each of the pixels to generate a summed brightness attenuation value. The update circuit 110 then updates the aging record table by saving the summed brightness attenuation value back to the memory 12 to serve as an updated brightness attenuation value.

The compensation circuit 111 is coupled to the panel 10 and the memory 12. The compensation circuit 111 may perform the aging compensation for each of the pixels. In detail, the compensation circuit 111 may compensate display data of each of the pixels according to the brightness attenuation value of each of the pixels, so that each of the pixels is displayed according to the compensated display data. Since the aging of the pixels is a gradual process, in an embodiment, the compensation circuit 111 may only read the first section 120 in the memory 12 to obtain the first portion brightness attenuation values, and perform the aging compensation on the pixel according to the first portion attenuation values.

In detail, in the aging compensation, the compensation circuit 111 may receive the display data of the pixel, and the compensation circuit 111 may also read the first section 120 to obtain the first portion attenuation values of the pixels, and query a compensation table according to the first portion attenuation values, thereby compensating the display data of the pixels. The compensation circuit 111 further provides the compensated display data to the panel 10 for display, so that the panel 10 may display according to the compensated display data. In this way, the compensation circuit 111 may compensate the display data of the panel 10 according to the first portion attenuation values, so that color fading of the panel 10 does not occur during display. For example, an object compensated by the compensation circuit 111 may be the display data, the grayscale value, the display brightness, the applied voltage, the applied current, or other suitable signal types of the pixel.

Figure 3:
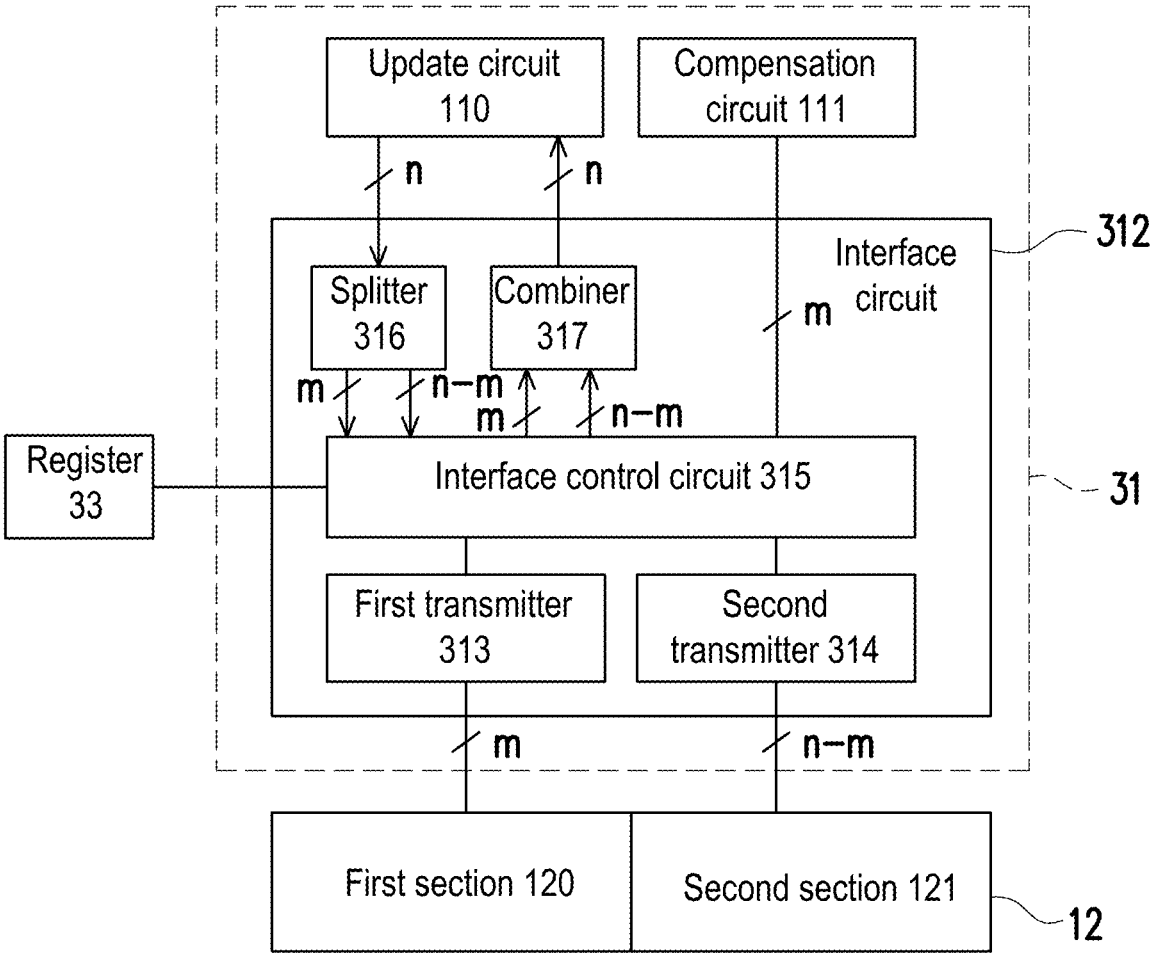
FIG. 3 is a schematic diagram of a controller according to an embodiment of the disclosure.

FIG. 3 is a schematic diagram of a controller 31 according to an embodiment of the disclosure. The controller 31 may be applied to the display device 1 shown in FIG. 1 and replace the controller 11. The controller 31 may include the update circuit 110, the compensation circuit 111, and an interface circuit 312. The interface circuit 312 is coupled to the memory 12, a register 33, the update circuit 110, and the compensation circuit 111. The interface circuit 312 includes a first transmitter 313, a second transmitter 314, an interface control circuit 315, a combiner 316, and a splitter 317. Reference may be made to the preceding paragraphs for the description of the update circuit 110 and the compensation circuit 111, which are omitted here.

In detail, the first transmitter 313 is coupled to the first section 120 of the memory 12, so as to read and/or write to the first section 120. The second transmitter 314 is coupled to the second section 121 of the memory 12, so as to read and/or write to the second section 121. The interface control circuit 315 is coupled to the first transmitter 313 and the second transmitter 314, so as to control accessing of the first section 120 and the second section 121 in the memory 12. The combiner 316 is coupled to the update circuit 110 and the interface control circuit 315. The combiner 316 receives the first portion attenuation values read by the first transmitter 313 and the second portion attenuation values read by the second transmitter 314 from the interface control circuit 315. The combiner 316 may combine the first portion attenuation values and the second portion attenuation values corresponding to each other into the brightness attenuation values, and provide the brightness attenuation values to the update circuit 110. The splitter 317 is coupled to the update circuit 110 and the interface control circuit 315. The splitter 317 receives the updated brightness attenuation values from the update circuit 110. The splitter 317 segments the updated brightness attenuation values into updated first portion attenuation values and updated second portion attenuation values, and provides them to the interface control circuit 315. Accordingly, the interface update circuit 315 may write the updated first portion attenuation values to the first section 120 of the memory 12 through the first transmitter 313, and the interface update circuit 315 may write the updated second portion attenuation values to the second section 121 of the memory 12 through the second transmitter 314.

In short, the interface circuit 312 may access the first section 120 and the second section 121 of the memory 12. The interface circuit 312 may obtain the first portion attenuation value of the m bits stored in the first section 120 and the second portion attenuation value n-m bits stored in the second section 121. On one hand, the interface circuit 312 may provide the first portion attenuation value to the compensation circuit 111. On the other hand, the interface circuit 312 may combine the first portion attenuation value and the second portion attenuation value into the brightness attenuation value and provide it to the update circuit 110, the interface circuit 312 may obtain the updated brightness attenuation value from the update circuit 110, split the updated brightness attenuation value into the first portion attenuation value and the second portion attenuation value, and respectively write the values to the first section 120 and the second section 121 of the memory 12. Therefore, the update circuit 110 and the compensation circuit 111 may correctly access the memory 12.

In another embodiment, as shown in FIG. 3, the display device 1 may further include the register 33, which is coupled to the interface control circuit 315, and the register 33 may serve as a temporary storage space of the interface control circuit 315. The register 33 may be, for example, a static random access memory (SRAM), and an access speed of the register 33 may be faster than that of the memory 12, so as to provide a temporary storage space for the controller 31 when performing an access operation.

Figure 4A:
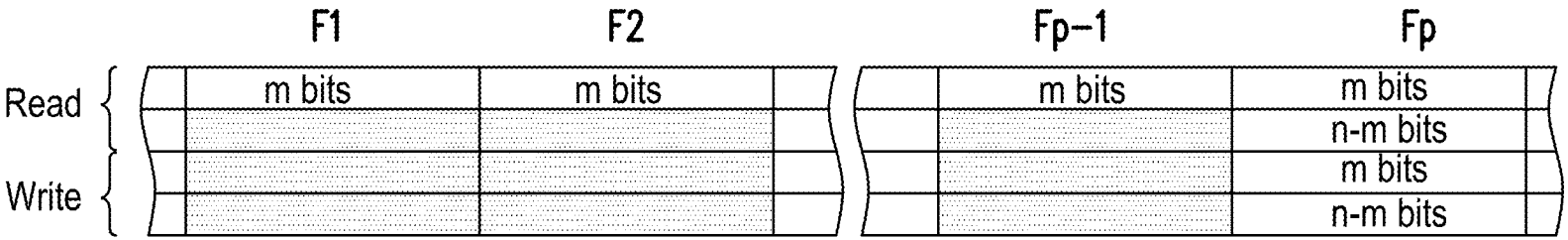
FIG. 4A is a schematic diagram of an access timing sequence performed by the controller on the memory according to an embodiment of the disclosure.

FIG. 4A is a schematic diagram of an access timing sequence performed by the controller 11/31 on the memory 12 according to an embodiment of the disclosure. Reference is made to FIG. 4A to understand read and write operations between the controller 11/31 and the memory 12. As shown in FIG. 4A, the controller 11/31 may periodically perform the read and write operation on the memory 12 with p frame times of F1 to Fp as a cycle, where p is a positive integer greater than one. In detail, in each of the frame times of F1 to Fp in the cycle, the controller 11/31 may perform the read operation on the first section 120 of the memory 12, so as to obtain the first portion attenuation values. In addition, in each of the cycles, the controller 11/31 may perform the read operation on the second section 121 once to obtain the second portion attenuation values. That is to say, in every p frame times, the controller 11/31 only reads the second section 121 once to obtain the second portion attenuation value.

In detail, in each of the frame times of F1 to Fp, the controller 11/31 may read the first section 120 to obtain the first portion attenuation values, and the compensation circuit 111 may obtain the first portion attenuation values to perform the aging compensation on the pixels in the panel 10.

In addition, in the frame time Fp, in addition to reading the first section 120, the controller 11/31 may also read the second section 121 and write to the first section 120 and the second section 121. In detail, in the frame time Fp, the controller 11/31 may update the aging record table according to the display content of each of the pixels in the frame times of F1 to Fp. Therefore, the controller 11/31 may read the first section 120 and the second section 121 in the frame time Fp to obtain the first portion attenuation value and the second portion attenuation value, that is, a complete brightness attenuation value. After the update circuit 110 sums the brightness attenuation value and the brightness variation value, so as to generate the updated brightness attenuation value, the controller 11/31 may write the updated brightness attenuation value to the first section 120 once to update the first portion attenuation value, and the controller 11/31 may write to the second section 121 once to update the second portion attenuation value.

In an embodiment, an update frequency of the pixels in the panel 10 may be 60 Hertz (Hz), and p may be 240. That is, the controller 11/31 may update the stored aging record table in the memory 12 in every four seconds, but the disclosure is not limited thereto. As long as p is a positive integer greater than one, it still falls within the scope of the disclosure.

Therefore, the display device 1 may use the p frame times as the cycle. In each of the frame times of F1 to Fp in the cycle, the compensation circuit 111 may all read the first section 120 to obtain the first portion attenuation values, so as to perform the aging compensation in each of the frame times of F1 to Fp. In addition, in the frame times of F1 to Fp of each of the cycles, the controller 11/31 may read the second section 121 once to obtain the second portion attenuation values, and the controller 11/31 may write to the first section 120 and the second sections 121 once, so as to write the first portion attenuation values to the first section 120 and write the second portion attenuation values to the second section 121 to update the aging record table.

On one hand, in the cycle of the p frame times, for each of the brightness attenuation values, the controller 11/31 only reads the second section 121 once and writes to the first section 120 and the second section 121 once. Therefore, the data throughput between the controller 11/31 and the memory 12 can be effectively reduced, and the data bandwidth of the display device 1 can be effectively improved. On the other hand, when the display device 1 is turned on, the controller 11/31 only needs to read the first portion attenuation values from the first section 120 of the memory 12 to enable the display device 1 to display a screen, therefore it can effectively improve a boot-up speed of the display device 1 even more.

Figure 4B:
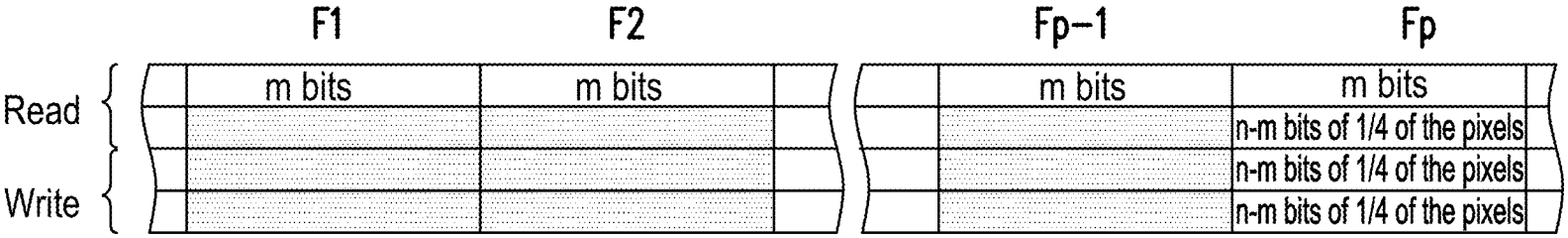
FIG. 4B is a schematic diagram of an access timing sequence performed by the controller on the memory according to an embodiment of the disclosure.

FIG. 4B is a schematic diagram of an access timing sequence performed by the controller 11/31 on the memory 12 according to an embodiment of the disclosure. Roughly speaking, in every p frame times of F1 to Fp, the controller 11/31 may only update the brightness attenuation values in the aging record table corresponding to some of the pixels. In the embodiment shown in FIG. 4B, in every p frame times of F1 to Fp, the controller 11/31 only updates the brightness attenuation values in the aging record table corresponding to ¼ of the pixels. In the embodiment, p may be a positive integer. In this way, with 4 p frame times as a cycle, the controller 11/31 may completely update the brightness attenuation values in the aging record table in the cycle of 4 p frame times.

In detail, the pixels in the panel 10 may be divided into multiple pixel groups, and in every p frame times of F1 to Fp, the controller 11/31 only updates the brightness attenuation values corresponding to one of the pixel groups. In the embodiment shown in FIG. 4B, the pixels in the panel 10 may be divided into four pixel groups, and in every p frame times of F1 to Fp, the controller 11/31 only updates the brightness attenuation values corresponding to the pixel group formed by ¼ of the pixels.

Therefore, in the frame times of F1 to Fp, the controller 11/31 may read the first section 120 at each of the frame times of F1 to Fp to obtain the first portion attenuation values, so that the compensation circuit 111 may obtain the first portion attenuation values to perform the aging compensation on the pixels in the panel 10. In addition, in the frame times of F1 to Fp, the controller 11/31 may read the second section 121 only once to obtain the second portion attenuation values corresponding to a pixel group to be updated. After the update circuit 110 generates the updated brightness attenuation values, the controller 11/31 may write to the first section 120 and the second section 121 only once to update the brightness attenuation values corresponding to the pixel group to be updated.

For example, the pixels in the panel 10 may be divided into four pixel groups, the update frequency of the pixels in the panel 10 may be 60 Hz, and p may be 60. In other words, the controller 11/31 may update the aging record table corresponding to the pixel group that is ¼ of the pixels in the memory 12 in frame times of 1 to 60 (that is, a first second), and the controller 11/31 may update the aging record table corresponding to a pixel group that is another ¼ of the pixels in the memory 12 in frame times of 61 to 120 (that is, a second second), and so on, until four seconds later, the controller 11/31 may completely update the aging record table, that is, an update cycle is completed. Therefore, after a cycle (that is, four seconds) formed by 240 frame times, the controller 11/31 may complete an overall update of the aging record table in the memory 12. The above-mentioned embodiments are for illustrative purposes only, and the disclosure is not limited thereto. As long as p is a positive integer, it still falls within the scope of the disclosure.

Of course, in each of the cycles, the controller 11/31 may also arbitrarily select a frame time to update. For example, when a cycle is eight frame times, the controller 11/31 may select four of the frame times to update the aging record table corresponding to the pixel group of ¼ of the pixels. In an embodiment, the controller 11/31 may update in the first four frame times or the last four frame times. In an embodiment, the controller 11/31 may update in odd numbers or even numbers frame times. In an embodiment, the controller 11/31 may update in four frame times generated by arbitrary selection or random number, which all falls within the scope of the disclosure.

Figure 4C:
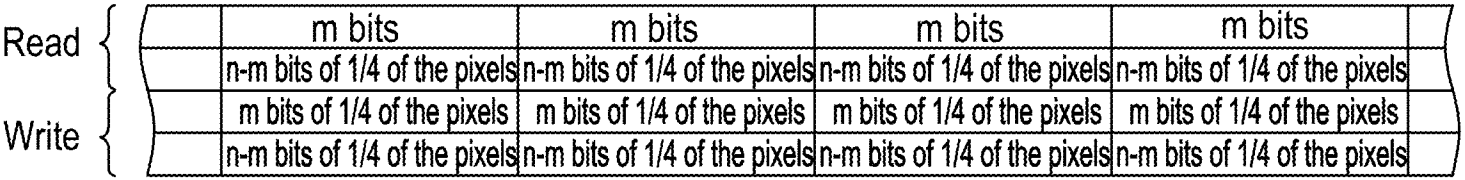
FIG. 4C is a schematic diagram of an access timing sequence performed by the controller on the memory according to an embodiment of the disclosure.

Because the aging is a very long process and has a characteristic of slow accumulation, therefore it is possible to use time-sharing partitioning methods, as shown in FIGS. 4B and 4C to reduce the average and maximum bandwidth of DDR. For example, preventing an occurrence where a largest bandwidth requirement in FIG. 4A in a specific frame exceeds a bandwidth load of a bandwidth memory unit.

FIG. 4C is a schematic diagram of an access timing sequence performed by the controller 11/31 on the memory 12 according to an embodiment of the disclosure. The embodiment shown in FIG. 4C may be regarded as an extension of the embodiment shown in FIG. 4B, except that in the embodiment shown in FIG. 4C, p is 1. In this way, in each of frame times F1 to F4, the controller 11/31 may sequentially update the brightness attenuation values in the aging record table corresponding to each of the pixel groups.

In the embodiment, the pixels in the panel 10 may be divided into four pixel groups. In each of the frame times F1 to F4, the controller 11/31 may perform the read and write operations to the first section 120 and the second section 121 of the memory 12. More specifically, the controller 11/31 may read the first section 120 to obtain the first portion attenuation values of all the pixels. In addition, the controller 11/31 may read the second section 121 to obtain the second portion attenuation values corresponding to ¼ of the pixels. The first portion attenuation values of all the pixels may be provided to the compensation circuit 111 to perform the aging compensation. In addition, the brightness attenuation values (including the first portion attenuation values and the second portion attenuation values) corresponding to ¼ of the pixels may be provided to the update circuit 110 to generate the updated brightness attenuation values. Finally, the controller 11/31 may write the first portion attenuation values of the updated brightness attenuation values to the first section 120, and the controller 11/31 may write the second portion attenuation values of the updated brightness attenuation values to the second section 121. In this way, after the frame times F1 to F4, the controller 11/31 may complete the overall update of the aging record table in the memory 12.

In an embodiment, the pixels of the panel 10 may be divided into 240 pixel groups, and the update frequency of the pixels in the panel 10 may be 60 Hz. In other words, the controller 11/31 may update the brightness attenuation values in the aging record table corresponding to 1/240 of the pixels every frame time. Therefore, the controller 11/31 may complete the overall update of the aging record table after 4 seconds. The above-mentioned embodiments are for illustrative purposes only, and the disclosure is not limited thereto. As long as p is a positive integer, it falls within the scope of the disclosure.

In short, the pixels in the panel 10 are divided into the multiple pixel groups, and the brightness attenuation values in the aging record table corresponding to each of the pixel groups is further updated in time. As a result, the data throughput between the controller 11/31 and the memory 12 can be evenly distributed in each of the frame times. In addition to effectively improving an average data bandwidth of the display device 1, a maximum bandwidth required between the controller 11/31 and the memory 12 when updating the aging record table can also be effectively reduced, further supporting a fast boot-up function of the display device 1.

Figure 5A:
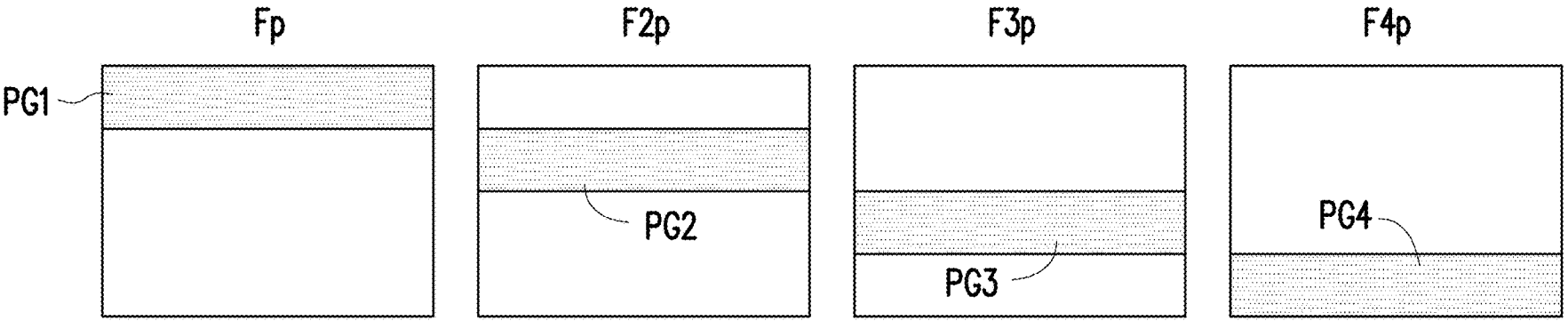
FIGS. 5A and 5B are schematic diagrams of updating a pixel group in the panel according to an embodiment of the disclosure.
Figure 5B:
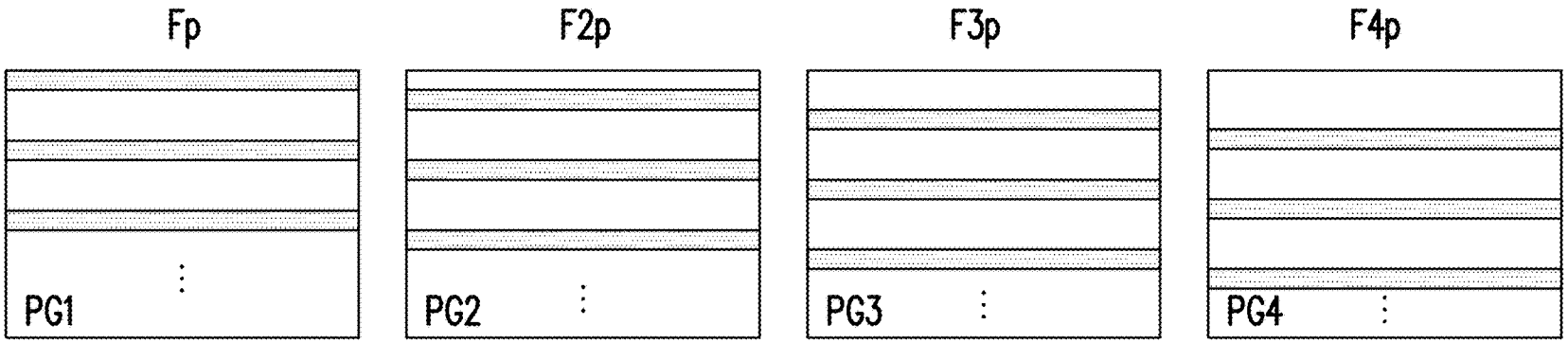

With reference to FIGS. 5A and 5B, FIGS. 5A and 5B are schematic diagrams of updating pixel groups PG1 to PG4 in the panel 10 according to an embodiment of the disclosure. First, in the embodiment shown in FIG. 5A, the pixels in the panel 10 are divided into four pixel groups PG1 to PG4, and each of the pixel groups PG1 to PG4 includes multiple adjacent pixel rows, and each of the pixel groups PG1 to PG4 are arranged in order in the panel 10. Therefore, as shown in FIG. 5A, every time the aging record table is updated, that is, in frame times Fp, F2p, F3p, F4p, one of the pixel groups PG1 to PG4 may be updated correspondingly.

In addition, in the embodiment shown in FIG. 5B, the pixels in the panel 10 are divided into the four pixel groups PG1 to PG4, and each of the pixel groups PG1 to PG4 also includes multiple pixel subgroups, and the pixel subgroups of each of the pixel groups PG1 to PG4 are arranged alternately. Therefore, as shown on right side of FIG. 5B, every time the aging record table is updated, that is, in the frame times Fp, F2p, F3p, F4p, one of the pixel groups PG1 to PG4 may be updated accordingly.

In summary, the display device of the disclosure divides the brightness attenuation values in the aging record table into the first portion attenuation values and the second portion attenuation values, and respectively stores them in the first section and the second section of the memory, so as to record the aging degree of each of the pixels. In this way, the bandwidth required to access the memory in the display device can be effectively reduced, and the fast boot-up function of the display device 1 is further supported.

Although the disclosure has been disclosed with the foregoing exemplary embodiments, it is not intended to limit the disclosure. Any person skilled in the art can make various changes and modifications within the spirit and scope of the disclosure. Accordingly, the scope of the disclosure is defined by the claims appended hereto and their equivalents.

What is claimed is:

1. A display device, comprising:

a panel, comprising a plurality of pixels;

a memory, storing an aging record table that records a plurality of brightness attenuation values respectively corresponding to the plurality of pixels, and the brightness attenuation values are divided into a plurality of first portion attenuation values and a plurality of second portion attenuation values according to bit order of the brightness attenuation values, the memory comprising:

a first section, storing the plurality of first portion attenuation; and a second section, storing the plurality of second portion attenuation values;

a controller, coupled to the panel and the memory, comprising:

an update circuit, receiving a plurality of grayscale values displayed by the plurality of pixels to update the aging record table; and a compensation circuit, reading the first section to obtain the plurality of first portion attenuation values to perform an aging compensation on the plurality of pixels.

2. The display device according to claim 1, wherein each of the plurality of brightness attenuation values has n bits, each of the plurality of first portion attenuation values is m most significant bits (MSB) of the each of the plurality of brightness attenuation values, and each of the plurality of second portion attenuation values is n-m least significant bits (LSB) of the each of the plurality of brightness attenuation values.

3. The display device according to claim 1, wherein the update circuit generates a plurality of brightness variation values corresponding to the plurality of pixels according to the plurality of grayscale values, and the update circuit sums each of the plurality of brightness attenuation values and each of the plurality of brightness variation values, so as to update the aging record table.

4. The display device according to claim 1, wherein the compensation circuit in the aging compensation is configured to:

receive a plurality of display data, query a compensation table according to the plurality of first portion attenuation values to compensate the plurality of display data, and provide the compensated plurality of display data to the panel for display.

5. The display device according to claim 1, wherein the controller further comprises:

an interface circuit, coupled to the memory, the update circuit, and the compensation circuit, wherein the interface circuit comprises:

a first transceiver, coupled to the first section of the memory, so as to read or write to the first section;

a second transceiver, coupled to the second section of the memory, so as to read or write to the second section;

an interface control circuit, coupled to the first transmitter and the second transmitter, so as to control accessing of the memory;

a combiner, coupled to the update circuit and the interface control circuit, wherein the combiner receives the plurality of first portion attenuation values read by the first transceiver and the plurality of second portion attenuation values read by the second transceiver through the interface control circuit, the combiner combines each of the plurality of first portion attenuation values and each of the plurality of second portion attenuation values into each of the brightness attenuation values, and provides them to the update circuit; and a splitter, coupled to the update circuit and the interface control circuit, wherein the splitter receives an updated plurality of brightness attenuation values from the update circuit, and splits the updated plurality of brightness attenuation values into an updated plurality of first portion attenuation values and an updated plurality of second portion attenuation values, and provide the updated first portion attenuation values to the first transmitter through the interface control circuit, and provide the updated plurality of second portion attenuation values to the second transmitter.

6. The display device according to claim 5, further comprising:

a register, coupled to the interface control circuit, and configured to serve as a temporary storage space for the interface control circuit.

7. The display device according to claim 1, wherein the controller reads the first section in each frame time to obtain the plurality of first portion attenuation values to perform the aging compensation on the plurality of pixels.

8. The display device according to claim 7, wherein in every p frame times, the controller reads the second section once to obtain the plurality of second portion attenuation values, and after the update circuit generates an updated plurality of brightness attenuation values, the controller writes to the first section once to update the plurality of first portion attenuation values, and the controller writes to the second section once to update the plurality of second portion attenuation values, where p is a positive integer greater than one.

9. The display device according to claim 8, wherein the update circuit generates a plurality of brightness variation values of the plurality of pixels according to the plurality of grayscale values displayed by the plurality of pixels in the p frame times, and the update circuit sums each of the plurality of brightness variation values and each of the plurality of brightness attenuation values, so as to generate the updated plurality of brightness attenuation values.

10. The display device according to claim 7, wherein the plurality of pixels are divided into a plurality of pixel groups, wherein after p frame times, the controller reads the second section once to obtain the plurality of second portion attenuation values corresponding to each of the pixel groups, and after the update circuit updates the plurality of brightness attenuation values corresponding to the each of the pixel groups, the controller writes to the first section once to update the plurality of first portion attenuation values, and the controller writes to the second section once to update the plurality of second portion attenuation values, where p is a positive integer.

* * * * *